US007631693B2

(12) United States Patent
Tong et al.

(10) Patent No.: US 7,631,693 B2
(45) Date of Patent: Dec. 15, 2009

(54) RETRIEVABLE PLUG SYSTEM AND METHODS OF USE

(75) Inventors: Phillip M. Tong, Edmonton (CA); Kosay El-Rayes, Dubai (AE)

(73) Assignee: National Oilwell Varco, L.P., Houston, TX (US)

( * ) Notice: Subject to any disclaimer, the term of this patent is extended or adjusted under 35 U.S.C. 154(b) by 278 days.

(21) Appl. No.: 11/451,089

(22) Filed: Jun. 12, 2006

(65) Prior Publication Data

US 2007/0029084 A1 Feb. 8, 2007

Related U.S. Application Data

(60) Provisional application No. 60/706,486, filed on Aug. 8, 2005.

(51) Int. Cl.
*E21B 47/09* (2006.01)
*E21B 33/13* (2006.01)

(52) U.S. Cl. ..... 166/255.2; 166/386; 166/113; 166/135; 166/140

(58) Field of Classification Search ..... 166/255.1, 166/255.2, 378, 386, 135, 195, 140, 113
See application file for complete search history.

(56) References Cited

U.S. PATENT DOCUMENTS 2,886,110 A 5/1959 Baker
3,783,941 A 1/1974 Kisling
4,862,961 A 9/1989 Neff
5,647,437 A 7/1997 Braddick
6,446,717 B1 * 9/2002 White et al. ..... 166/187
7,051,806 B2 * 5/2006 Dodd ..... 166/242.2

FOREIGN PATENT DOCUMENTS

WO WO 0061310 10/2000

OTHER PUBLICATIONS

EP Search Report dated Nov. 24, 2006 for Application No. EP 06254018 (6 p.).
Progressive Technology Surface Isolation Plug, Series 2000-000.
Select Energy Systems Surface Isolation Plug.
Select Energy Systems Surface Isolation Plug Installation Tool.

* cited by examiner

*Primary Examiner*—David J Bagnell
*Assistant Examiner*—David Andrews
(74) *Attorney, Agent, or Firm*—Conley Rose P.C.

(57) ABSTRACT

Apparatus and method for a retrievable plug in coil tubing. A plug is disposed within a tubing and is set within the tubing by an anchoring element placed in gripping engagement with the tubing. The plug also has seal elements disposed therein that are placed in sealing engagement with the tubing. An orientation element on the plug positions the plug within the tubing with respect to the seam of the tubing.

28 Claims, 5 Drawing Sheets

RETRIEVABLE PLUG SYSTEM AND METHODS OF USE

CROSS-REFERENCE TO RELATED APPLICATIONS

The present application claims the benefit of, and incorporates by reference, provisional application Ser. No. 60/706,486, filed Aug. 8, 2005, and entitled "Retrievable Plug System."

STATEMENT REGARDING FEDERALLY SPONSORED RESEARCH OR DEVELOPMENT

Not applicable.

FIELD OF THE INVENTION

The present invention relates generally to retrievable plugs and more particularly relates to retrievable plugs for placement in pressurized hydrocarbon wells to temporarily seal a portion of the well. Still more particularly, the present invention relates to a retrievable plug that can be oriented in coil tubing.

BACKGROUND

During hydrocarbon drilling operations, it may become necessary to permanently or temporarily seal off a portion or various zones of a wellbore. Plugs are tools that are typically lowered into a cased hydrocarbon well and provide a seal to isolate two zones in the well when set in position inside the casing. Retrievable plugs provide temporary sealing and separation of zones during drilling and workover operations. Typically, conventional retrievable plugs are characterized by anchoring elements, such as conventional slips, and also generally include one of a variety of conventional rubber seal or packing elements.

The anchoring elements are used to grip the inside surface of the well casing to prevent the set plug from moving within the casing. The seal or packing elements also engage the inside surface of the well casing to seal the annulus between the plug and well casing. A retrievable plug is removed from the well casing through the release and retraction of the anchoring elements and sealing or packing elements after the shear member is activated.

Typically, retrievable plugs are designed for use with a range of large diameter casing tubing sizes. In some instances, a plug may be desired to seal sections of coil tubing, wherein the coil tubing may or may not include a longitudinal seam along the tubing inner surface. However, in coil tubing applications, where the tubing diameters can be smaller and the plugs are typically deployed at the bottom of the tubing, retrievable plugs have not been consistently utilized, especially where the coil tubing is characterized by a seam along the inner wall of the coil tubing. The presence of an inner wall seam spanning the length of the coil tubing makes it difficult to properly orient the plug and as a result to completely seal the annulus between the plug and coil tubing. Also, the presence of the inner wall seam makes retrieving the plug difficult and economically inefficient.

Accordingly, there remains a need to develop new and improved systems and apparatus for a retrievable plug disposed in coil tubing near the surface that address certain of the foregoing difficulties.

SUMMARY OF THE PREFERRED EMBODIMENTS

The embodiments of the present invention are directed to methods and apparatus for plugging smaller-diameter coil tubing utilized in a wellbore. It is desired to provide a retrievable plug assembly for use in coil tubing characterized by a seam along the inner wall of the coil tubing. The embodiments of the retrievable plug assembly described herein may also be utilized in coil tubing without an inner wall seam.

In one embodiment of the present invention, a retrievable plug assembly for isolating or sealing sections of coil tubing comprises a mandrel, seal elements, setting cones, and a slip mechanism. The retrievable plug assembly is anchored within the coil tubing by the slip mechanism, which includes slips, a slip cage, a locking ring, and an anti-setting ring.

The retrievable plug assembly is lowered into coil tubing to the desired depth. In one embodiment, an orientation tool located on the plug assembly is used to ascertain the location and orientation of the seam of the coil tubing. In an alternative embodiment, a mule shoe orientation guide is used to position the plug assembly prior to insertion into the coil tubing so that the slips are positioned to engage the inner wall of the coil tubing between the seam of the coil tubing. An additional embodiment for locating the seam of the coil tubing includes making an prior trip into the wellbore with a separate tool on which an orientation tool is disposed before inserting the plug assembly.

Once the retrievable plug assembly is positioned in the coil tubing at the desired depth and orientation, the slip mechanism is activated. In one embodiment, the slip mechanism is activated through the introduction of pressurized hydraulic fluid into the plug assembly. In another embodiment, applying a mechanical force to the plug assembly activates the slip mechanism. When the slip mechanism is activated, the slips are wedged between the mandrel and setting cone, causing the slips to extend radially outward and ultimately engage the inner wall of the coil tubing. In conjunction with the downward movement of the slips, the setting cone is forced downward, and the seal elements are compressed between the setting cone and a collar. As the seal elements are compressed, the seal elements are forced to expand radially until sealingly engaging the inner wall of the coil tubing, thereby creating a seal between the plug assembly and the coil tubing.

To remove the retrievable plug assembly from the coil tubing, upward force is applied to the mandrel until a shear member located below the seal elements shears. The setting cones and slips become unwedged, allowing the slips to radially retract away from the inner wall of the coil tubing, thereby freeing the plug assembly from its anchored position. The anti-setting ring prevents the slips from re-setting during the removal of the plug assembly from the coil tubing.

The retrievable plug assembly is configured such that all the critical anchoring elements are located above the seal elements. As a result, the anti-setting ring and slips cannot be damaged by hydrocarbons emanating from the wellbore. Additionally, the disposition of the seal elements downhole of the critical anchoring elements allows the plug assembly to remain in the wellbore for the life of the seal elements.

Thus, the present invention comprises a combination of features and characteristics that are directed to overcoming various shortcomings of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

Figure 1A:
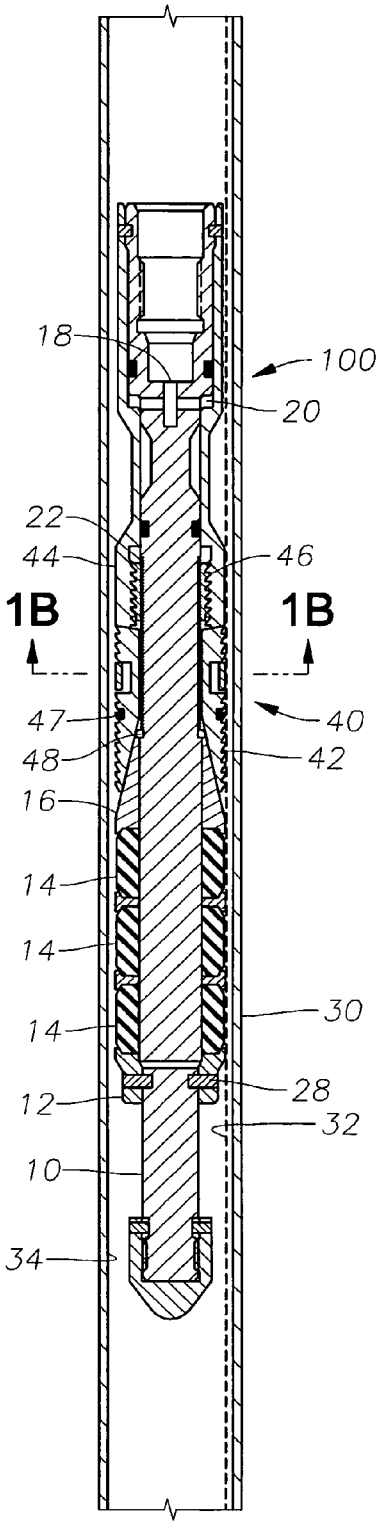
FIG. 1A is a cross-sectional elevation view of the hydraulically activated plug assembly with slips retracted.

In the description that follows, like parts are marked throughout the specification and drawings with the same reference numerals, respectively. The drawing figures are not necessarily to scale. Certain features of the invention may be shown exaggerated in scale or in somewhat schematic form, and some details of conventional elements may not be shown in the interest of clarity and conciseness. The present invention is susceptible to embodiments of different forms. There are shown in the drawings, and herein will be described in detail, certain embodiments of the present invention with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results.

Figure 1B:
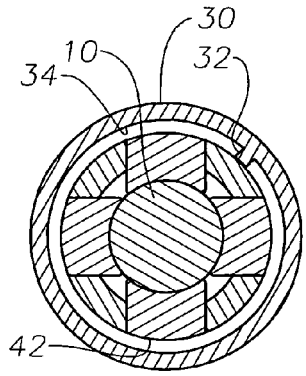
FIG. 1B is a cross-sectional view of the plug assembly with slips retracted.

Referring to FIG. 1A, one embodiment of retrievable plug assembly 100 includes mandrel 10, collar 12, seal elements 14, setting cone 16, shear member 28, and slip mechanism 40. Slip mechanism 40 includes slips 42, slip cage 44, locking ring 46, retaining ring 47, and anti-setting ring 48. Retrievable plug assembly 100 is disposed in coil tubing 30. In certain embodiments, coil tubing 30 may be characterized by the presence of seam 32 along inner wall 34, as shown in FIG. 1B. Seam 32 is formed as a result of the rolling process used during the manufacturing of coil tubing 30.

Plug assembly 100 is positioned in coil tubing 30 at the depth desired for setting, and is set using an anchoring element such as slip mechanism 40. While plug assembly 100 is lowered to the desired depth in coil tubing 30, anti-setting ring 48 prevents setting cone 16 from traveling up mandrel 10 and prematurely engaging slips 42. As a result, an early occurrence of extending slips 42 and setting plug assembly 100 is avoided. In certain embodiments slip mechanism 40 is activated through the introduction of pressurized hydraulic fluid from a source outside the wellbore (not shown). Hydraulic fluid is introduced through port 18 and applies pressure at cavity 20 that creates a downward force on slip cage 44. Slip cage 44 is forced down, and the additional components of slip mechanism 40 match that downward movement with respect to mandrel 10, setting cone 16, and seal elements 14.

Figure 2B:
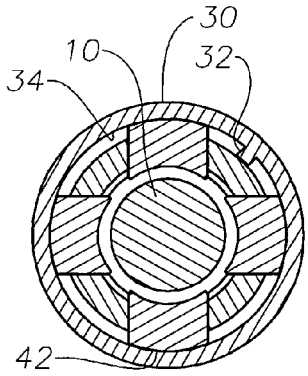
FIG. 2B is a cross-sectional view of the plug assembly with slips extended.
Figure 2A:
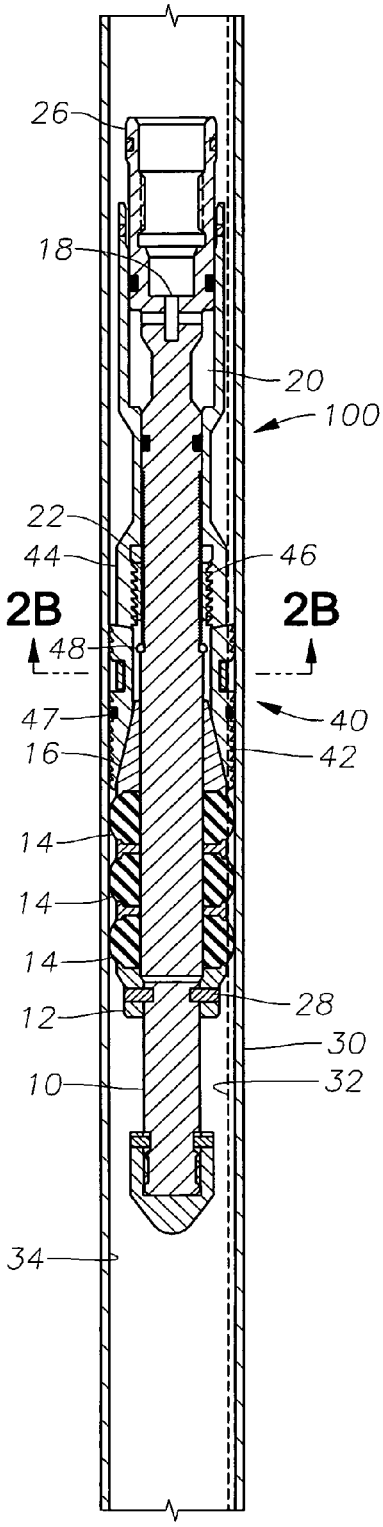
FIG. 2A is a cross-sectional elevation view of the hydraulically set plug assembly with slips extended.

As slip mechanism 40 moves downwardly, it is prevented from moving up in coil tubing 30 with respect to mandrel 10 by locking ring 46. Mandrel 10 has ratcheting teeth 22 that engage locking ring 46 to retain slip mechanism 40 in position. The downward motion of slip mechanism 40 forces slips 42 to engage the wedge surface on setting cone 16, thereby ramping slips 42 to extend radially outward until slips 42 engage inner wall 34 of coil tubing 30 and placing plug assembly in set position, as shown in FIGS. 2A and 2B. An upper portion of slips 42 protrude through slot 48 of slip cage 44, thereby locking slips 42 into the set position between setting cone 16 and slip cage 44. While slip mechanism 40 is forced downwardly and into the set position, seal elements 14 are compressed between setting cone 16 and collar 12. The compression of seal elements 14 causes the seal elements 14 to expand radially to create a sealing engagement between seal elements 14 and inner wall 34 of coil tubing 30.

Figure 3:
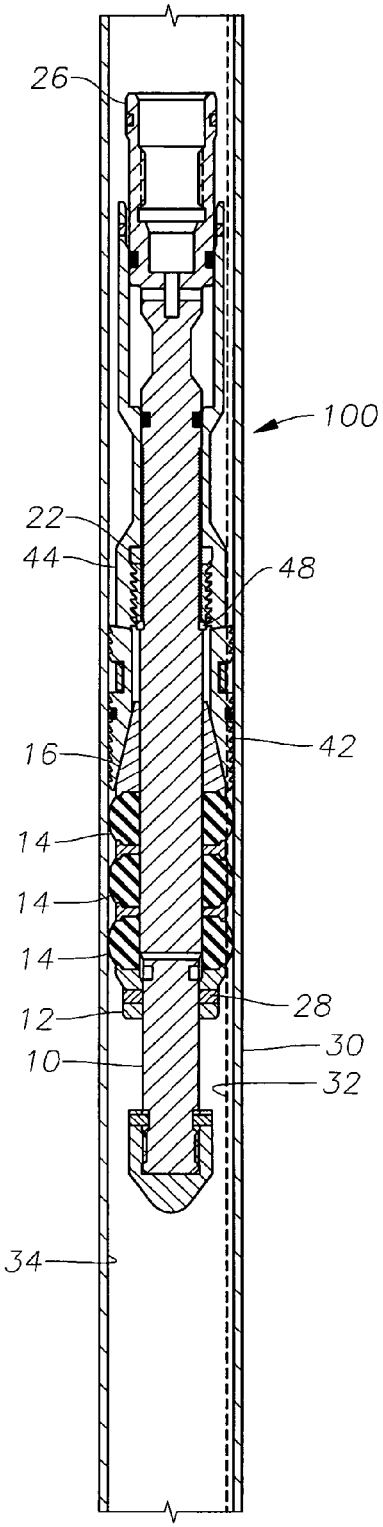
FIG. 3 is a cross-sectional elevation view of the hydraulically set plug assembly prior to removal.
Figure 4:
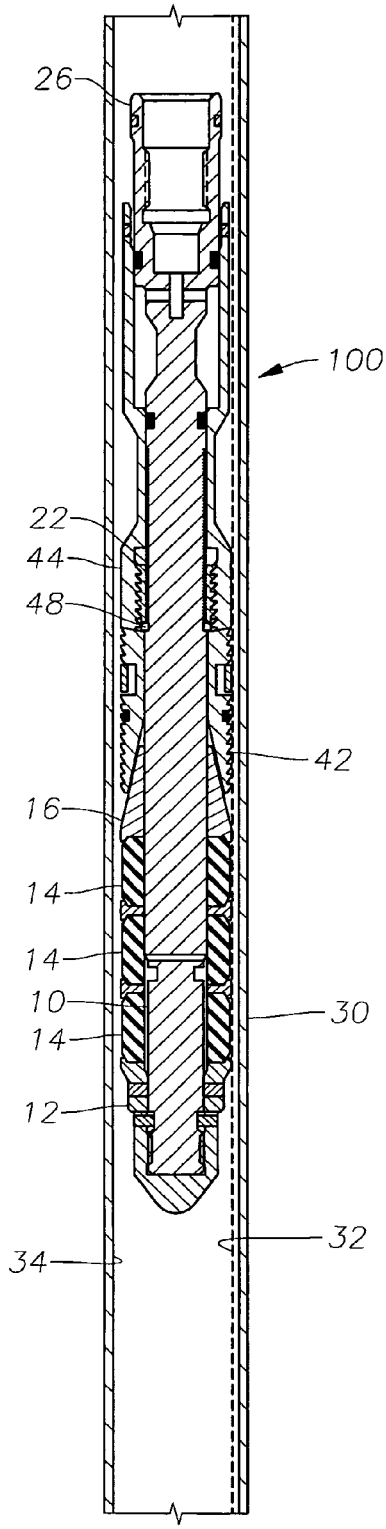
FIG. 4 is a cross-sectional elevation view of the hydraulically activated plug assembly during removal.
Figure 5A:
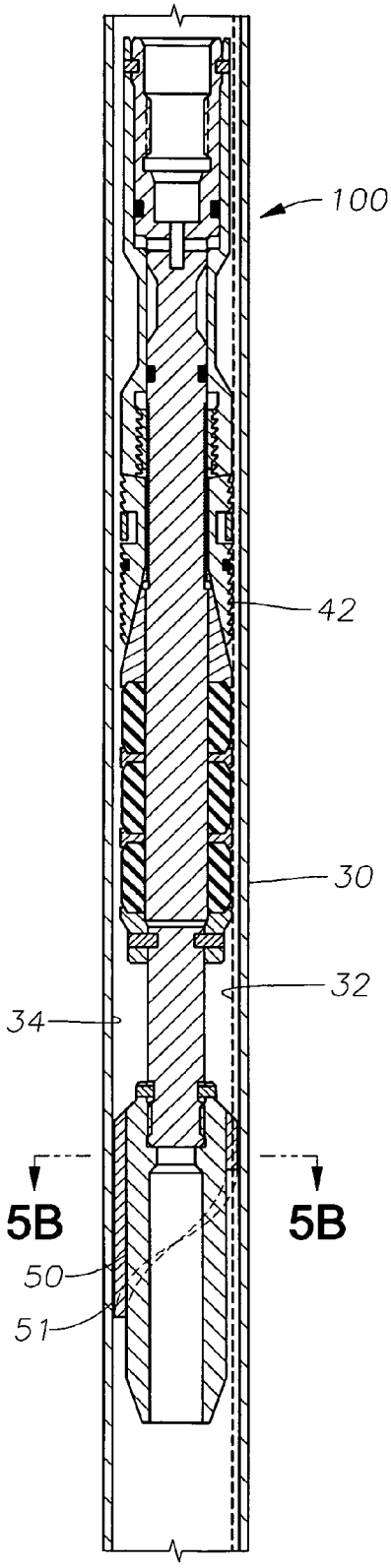
FIG. 5A is a cross-sectional elevation view of the plug assembly with mule shoe orientation guide.
Figure 5B:
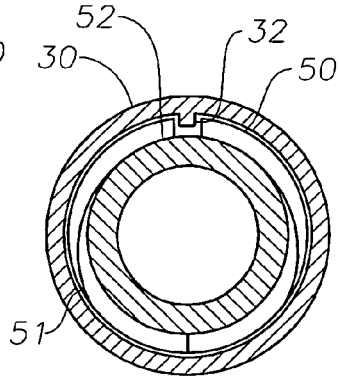
FIG. 5B is a cross-sectional view of the mule shoe orientation guide.

Referring now to FIGS. 3 and 4, when the removal of plug assembly 100 from coil tubing 30 is desired, a retrieving tool (not shown) is lowered into the wellbore and engages upper mandrel 26. An upward force is applied to upper mandrel 26 through the retrieving tool, such that shear member 28 is sheared and mandrel 10 is detached from collar 12. As a result of the upward movement of mandrel 10, slips 42 are unwedged from setting cone 16 and retracted from engagement with inner wall 34 of coil tubing 30. The retraction of slips 42 is aided by retaining ring 47, which is comprised of an elastomer material and contracts around slips 42 to pull slips 42 away from inner wall 34 as slips 42 are unwedged from setting cone 16. With the downward force on setting cone 16 released, seal elements 14 decompress, retract away from sealing engagement with inner wall 34 of coil tubing 30, and expand back to their approximate original size and shape. Once slips 42 are retracted and seal elements 14 are relaxed from sealing engagement with inner wall 34 of coil tubing 30, plug assembly 100 may be removed out of coil tubing 30.

An anti-setting element, including anti-setting ring 48, prevents slips 42 from reengaging inner wall 34 and re-setting plug assembly 100 during the removal of plug assembly 100 from coil tubing 30. Anti-setting ring 48 is disposed in a groove on the outer surface of mandrel 10 below ratcheting teeth 22. As slips 42 are unwedged from setting cone 16 and pulled upward with the rest of slip mechanism 40, slips 42 are maintained in a retracted position as a result of anti-setting ring 48 preventing the downward motion of locking ring 46. By stopping locking ring 46, anti-setting ring 48 also stops slip cage 44 from descending toward setting cone 16 and undesirably translating its motion to slips 42.

Referring again to FIGS. 1B and 2B, plug assembly 100 is desired to be oriented when disposed in coil tubing 30 such that slips 42 are set in a manner that slips 42 do not engage seam 32. In certain embodiments, orientation elements operate to orient plug assembly 100 and slips 42 in such a manner with respect to seam 32 in order to ensure that the centerline of plug assembly 100 matches that of coil tubing 30. Further, by orienting plug assembly 100 in this manner, the ability of seal elements 14 to sealingly engage inner wall 34 concentrically and to force seal elements 14 to wrap around and surround seam 32 is assisted. The sealing interface between seal elements 14 and seam 32 is thereby ensured to be tight.

Referring now to FIGS. 5A, 5B, 6A, and 6B, embodiments of plug assembly 100 that are constructed to include an orientation element for locating seam 32 are depicted. In the embodiment shown in FIG. 5A, plug assembly 100 includes an orientation element in the form of mule shoe orientation guide 50. Mule shoe orientation guide 50 may be utilized in embodiments where plug assembly 100 is run on a wireline. Mule shoe orientation guide 50 allows plug assembly 100, and specifically slips 42, to be properly oriented with respect to seam 32 at the surface and prior to insertion into coil tubing 30 such that slips 42 engage inner wall 34 in between seam 32, as shown in FIG. 2B. Mule shoe orientation guide 50 operates to orient plug assembly 100 with respect to seam 32 through the use of helical surface 51 and orienting groove 52. Helical surface 51 guides mule shoe orientation guide 50 and plug assembly 100 during insertion into and while disposed in coil tubing 30 so that orienting groove 52 is keyed to seam 32. In the present embodiment, it is preferred that orienting groove 52 and slips 42 are disposed on opposed radial sides of plug assembly 100 such that orienting grove 52 and slips 42 are neither aligned nor coplanar in order to ensure that slips 42 do not engage seam 32. The inclusion of mule shoe orientation guide 50 on plug assembly 100 allows plug assembly 100 to be self-orienting and to be used in deeper wells without the requirement of manipulating the orientation of plug assembly 100 at the surface.

Figure 6B:
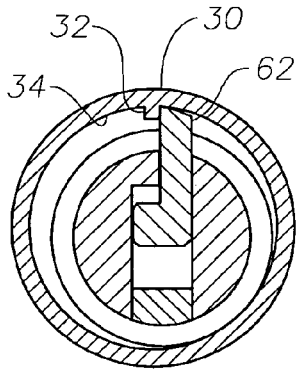
FIG. 6B is a cross-sectional view of the orientation tool.
Figure 6A:
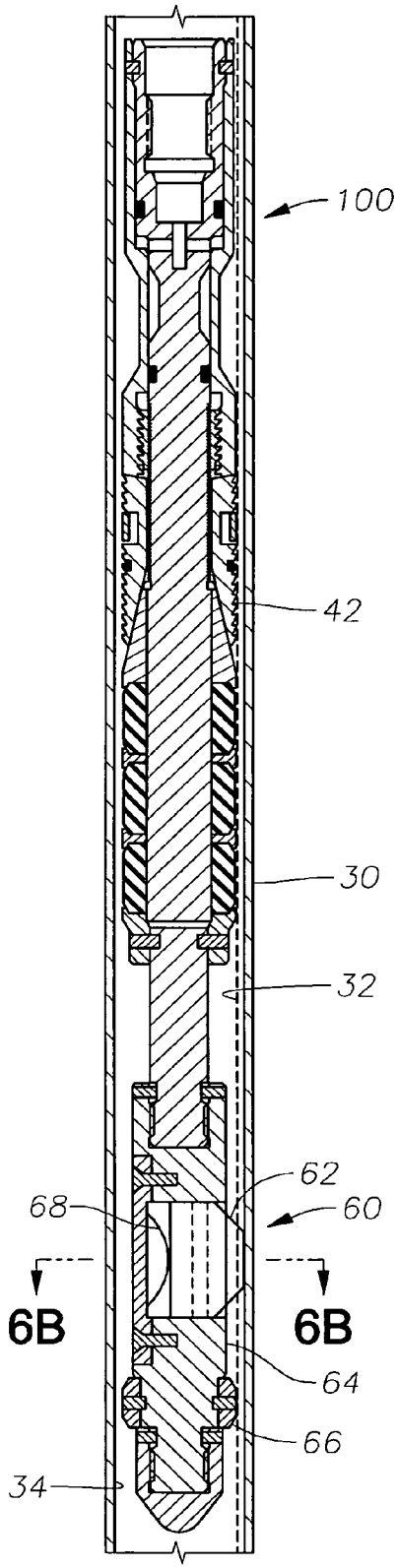
FIG. 6A is a cross-sectional elevation view of the plug assembly with orientation tool.

Referring now to FIG. 6A, in certain embodiments an orientation element in the form of orientation tool 60 is disposed on plug assembly 100. Orientation tool 60 assists in the proper orientation of plug assembly 100 so that slips 42 do not engage seam 32. Orientation tool 60 may be located at any point along plug assembly 100, but is preferably located at the end of plug assembly 100 that is first inserted into coil tubing 30. Orientation tool 60 locates the position of seam 32 along inner wall 34 of coil tubing 30 to ensure that slips 42 engage inner wall 34 of coil tubing 30 in between seam 32, as shown in FIG. 2B. Orientation tool 60 includes orientation key 62, orientation tool body 64, centralizing gauge rings 66, and spring 68.

Plug assembly 100 and orientation tool 60 are lowered into coil tubing 30, at which point orientation tool 60 is rotated until orientation key 62 catches seam 32, as shown in FIG. 6B. In the present embodiment, it is preferred that orientation key 62 and slips 42 are disposed on opposed radial sides of plug assembly 100 such that orientation key 62 and slips 42 are neither aligned nor co-planar in order to ensure that slips 42 do not engage seam 32. Centralizing gauge rings 66 operate to align orientation tool body and plug assembly 100 with the longitudinal axis of coil tubing 30. Orientation key 62 is kept in position to catch seam 32 by spring 68. As a result of utilizing orientation tool 60 to locate seam 32, there is no need for a prior additional trip down the wellbore with the purpose of finding seam 32 before inserting plug assembly 100.

Figure 7:
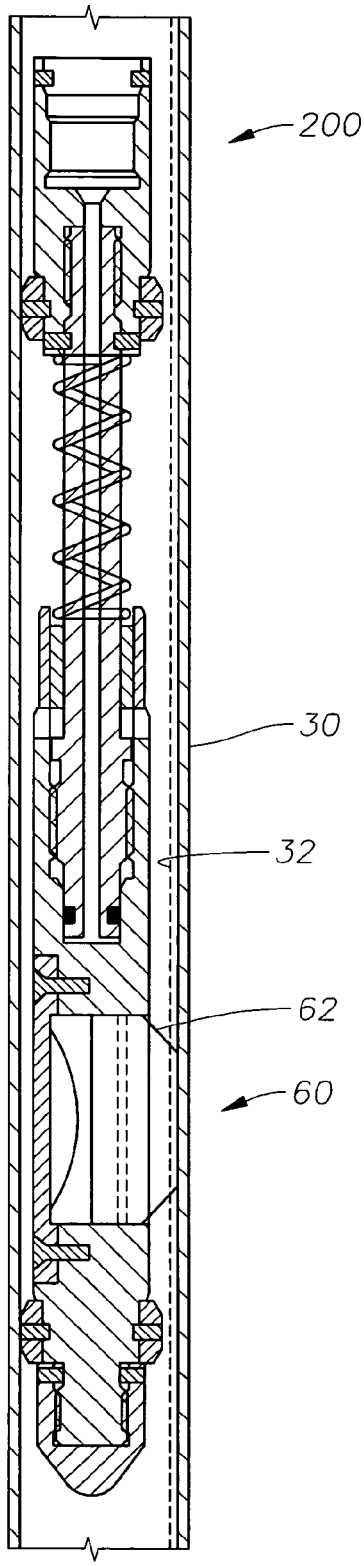
FIG. 7 is a cross-sectional elevation view of the orientation assembly.

Referring to FIG. 7, in an alternative embodiment orientation assembly 200 is utilized to locate seam 32 of coil tubing 30. Disposed on orientation assembly 200 is orientation tool 60, which includes orientation key 62. Orientation assembly 200 and orientation tool 60 are lowered into coil tubing 30 in a separate trip prior to the insertion of plug assembly 100 into coil tubing 30. Orientation assembly 200 and orientation key 60 are rotated until orientation key 62 catches seal 32, as shown in FIG. 6B, thereby indicating the location of seam 32 in coil tubing 30. Orientation assembly 200 is removed from coil tubing 30, and plug assembly 100 is lowered into coil tubing 30 in an orientation that prevents slips 42 from engaging seam 32, as shown for example in FIG. 2B, as a result of the prior location of seam 32 through the use of orientation assembly 200.

Figure 8:
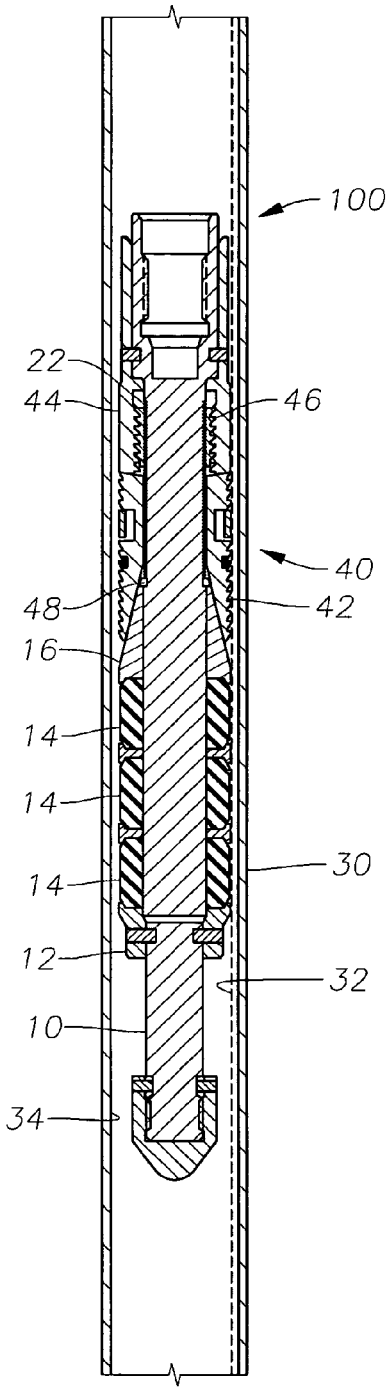
FIG. 8 is a cross-sectional elevation view of the mechanically activated plug assembly with slips retracted.
Figure 9:
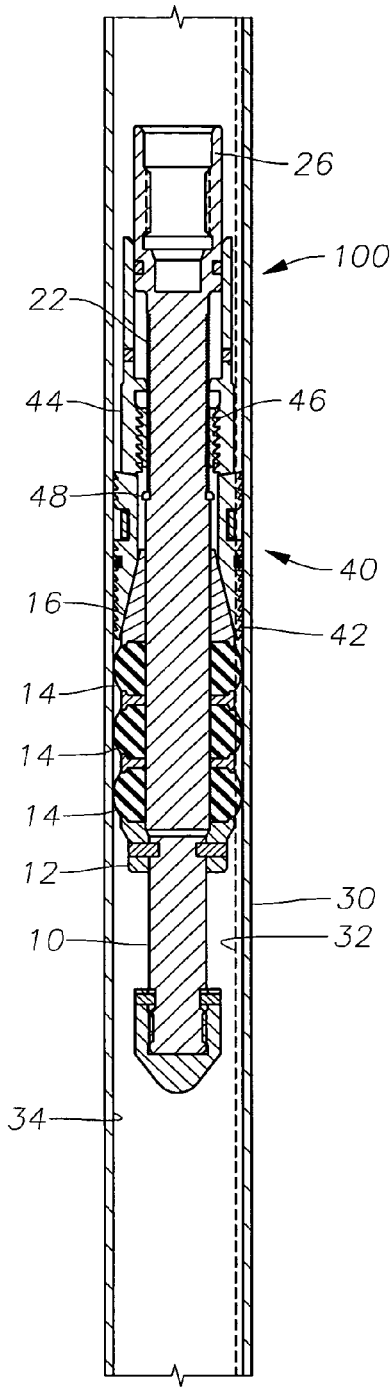
FIG. 9 is a cross-sectional elevation view of the mechanically set plug assembly with slips extended.

Referring to FIGS. 8 and 9, in an alternative embodiment, slip mechanism 40 is set through the application of hydraulically assisted downward mechanical force. A hydraulically powered setting tool (not shown) is inserted into upper mandrel 26. The setting tool applies a downward force, causing the downward motion of slip cage 44 with respect to mandrel 10. As slip cage 44 is forced downward, the remaining components of slip mechanism 40 also move downwardly, causing slips 42 to ramp on setting cone 16. Slips 42 extend radially and into engagement with inner wall 34 of coil tubing 30, placing plug assembly 100 in the set position. As slip mechanism 40 is forced further downward, seal elements 14 are compressed and expand radially until reaching sealed engagement with inner wall 34 of coil tubing 30.

Referring now to FIGS. 1A-9, in certain embodiments seal elements 14 comprise rubber with 50 durometer hardness or less. The 50 durometer seal elements 14 are manufactured by Parker Seal. The industry standard rubber durometer for the sealing or packing elements in downhole packer/plug applications is in the range of 60 to 90 durometer, which indicates the use of a much harder rubber compound. In contrast, the softer rubber compound utilized in certain embodiments of the current invention is crucial in order to sufficiently expand seal elements 14 when compressed through the application of the setting force. As a result of being comprised of a softer rubber compound, seal elements 14 can be squeezed around seam 32 in coil tubing 30, thereby creating a tighter pressure seal between plug assembly 100 and coil tubing 30. Additionally, multiple seal elements 14 can be used to further assist in the forming of a tight seal.

In alternative embodiments, the rubber compound consistency of seal elements 14 may be varied within the multiple seal element stack, with some seal elements 14 comprised of a rubber compound with hardness greater than 50 durometer. Use of seal elements 14 with a hardness greater than 50 durometer allows the plug assembly 100 to release when shear member 28 is sheared as a result of the application of upward force during removal of plug assembly 100. Seal elements 14 that feature a 50 durometer hardness or less exhibit more difficulty in springing back to the original shape after being compressed to set plug assembly 100 in coil tubing 30 and to place seal elements 14 into sealing engagement with inner wall 34 of coil tubing 30. The addition of seal elements 14 with a harder rubber compound and hardness over 50 durometer allows plug assembly 100 to release without surface manipulation since a higher durometer rubber compound more easily returns back to its original, pre-compressed form as slips 42 are released from the inner wall 34 of coil tubing 30.

Referring again to FIG. 1A, slip mechanism 40 is located above, or upstream, from seal element 14. As a result, the critical parts of slip mechanism 40 with regard to keeping plug assembly 100 anchored, such as slips 42, locking ring 48, and slip cage 44, are isolated from the hydrocarbons which may be present in the wellbore. Exposure of the critical anchoring components to hydrocarbons such as sour gas or di-hydrogen sulfide can result in damage to the parts or deterioration of their optimal function. Therefore, plug assembly

100 may remain in coil tubing 30 for the life of seal elements 14. Shear member 28 is exposed to sour gas and other hydrocarbons present in the wellbore due to the placement of shear member 28 below seal elements 14. In one embodiment, shear member 28 is comprised of a corrosion resistant alloy, the use of which can extend the life of shear member 28. Such corrosion resistant alloys are not as susceptible to experiencing changes in properties as a result of exposure to sour gas or other harmful hydrocarbons.

While preferred embodiments of this invention have been shown and described, modifications thereof can be made by one skilled in the art without departing from the scope or teaching herein. The embodiments described herein are exemplary only and are not limiting. Because many varying and different embodiments may be made within the scope of the present inventive concept, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. A plug assembly for use in a tubing, wherein the tubing has an inner surface along which a longitudinal seam extends, comprising:

an anchoring element operable to secure the plug assembly within the tubing, wherein the anchoring element is extendable from the plug assembly at a first circumferential position to engage the inner surface of the tubing at a location spaced apart from the seam;

a seal element operable to create a sealing engagement between the plug assembly and the inner surface of the tubing; and an orientation element configured to engage the seam and positioned on the plug assembly at a second circumferential position that is different from the first circumferential position;

wherein the spacing between the first and second circumferential positions is great enough such that when the orientation element engages the seam, the anchoring element engages the inner surface of the tubing but not the seam.

2. The plug assembly of claim 1 wherein said orientation element comprises a key, wherein said key is operable to catch said seam.

3. The plug assembly of claim 2 wherein said key and said anchoring element are located on opposed circumferential sides of said plug assembly.

4. The plug assembly of claim 2 wherein said orientation element comprises a mule shoe operable to guide the plug assembly during insertion into said tubing, wherein said mule shoe is positioned below said seal element and below said anchoring element.

5. The plug assembly of claim 4 wherein said mule shoe is characterized by a helical outer surface, and wherein the helical outer surface is further characterized by a helical groove.

6. The plug assembly of claim 5 wherein said helical groove engages said seam.

7. The plug assembly of claim 5 wherein said helical groove and said anchoring element are located on opposed circumferential sides of said plug assembly.

8. The plug assembly of claim 1 wherein said seal element comprises a compressible seal member.

9. The plug assembly of claim 8 wherein said seal member comprises a rubber compound with a 50 durometer hardness or less.

10. The plug assembly of claim 1 wherein said anchoring element comprises at least one radially expandable slip for engaging the inner surface of the tubing.

11. The plug assembly of claim 1 wherein said seal element is located below said anchoring element.

12. The plug assembly of claim 1 wherein said plug assembly further comprises an anti-setting element operable to prevent said anchoring element from radially expanding until said plug reaches the desired location within said tubing.

13. The plug assembly of claim 1 wherein said plug assembly further comprises an anti-setting element operable to prevent said anchoring element from radially expanding while said plug assembly is removed from said tubing.

14. The plug assembly of claim 1 wherein said anchoring element is mechanically activated.

15. The plug assembly of claim 1 wherein said anchoring element is hydraulically activated.

16. The plug assembly of claim 1 wherein said plug assembly is retrievable from said tubing, and wherein said anchoring element is mechanically releasable by operation of a shear member.

17. A method of locating a longitudinal seam in a tubing, comprising:

providing an orientation body;

disposing an orientation key on the orientation body, wherein the orientation key protrudes radially with respect to the orientation body;

providing a centralizing ring for aligning the orientation body with a longitudinal axis of the tubing;

providing an orientation spring for exerting an outward radial force on the orientation key, thereby causing the orientation key to engage the inner surface of the tubing; and inserting the orientation body into the tubing; and rotating the orientation body within the tubing until the orientation key engages the longitudinal seam.

18. A method of plugging a tubing, wherein the tubing has an inner surface characterized by a longitudinal seam, comprising:

providing a retrievable plug comprising:

an anchoring element extendable from the plug at a first circumferential position to engage the inner surface of the tubing at a location spaced apart from the seam;

a seal element disposed on the plug, wherein the seal element is compressible between a relaxed position and a radially expanded position; and an orientation element configured to engage the seam and positioned on the retrievable plug at a second circumferential position that is different from the first circumferential position;

wherein the spacing between the first and second circumferential positions is great enough such that when the orientation element engages the seam, the anchoring element engages the inner surface of the tubing but not the seam;

lowering the plug into the tubing;

orienting the plug with respect to the seam; and setting the plug, wherein setting the plug comprises:

radially expanding the anchoring element to engage the inner surface of the tubing; and radially expanding the seal element to engage and seal the tubing.

19. The method of claim 18 wherein said orientation element comprises a radially protruding key.

20. The method of claim 19 wherein said key and said anchoring element are disposed on opposed circumferential sides.

21. The method of claim 18 farther comprising the step of locking the anchoring element against setting until the plug is in the desired position.

22. The method of claim 18 wherein said seal element is positioned below said anchoring element.

23. The method of claim 18 further comprising guiding the orientation of said plug during installation, wherein said orientation element engages the seam during installation.

24. The method of claim 23 wherein said orientation element comprises a mule shoe characterized by a helical outer surface and a helical groove, wherein the helical groove engages the seam.

25. A method of plugging a tubing, wherein the tubing has an inner surface characterized by a longitudinal seam, comprising:

providing a retrievable plug comprising:

an anchoring element disposed on the plug, wherein the anchoring element is movable between an unset position with the anchoring element unexpanded and a set position with the anchoring element radially expanded;

a seal element disposed on the plug, wherein the seal element is compressible between a relaxed position and a radially expanded position; and an orientation element for locating the position of the seam within tubing;

lowering the plug into the tubing;

orienting the plug with respect to the seam;

setting the plug, wherein setting the plug comprises:

radially expanding the anchoring element to engage the inner surface of the tubing; and radially expanding the seal element to engage and seal the tubing; and rotating said plug until said orientation element engages said seam.

26. A method of constructing a plug assembly for use in a tubing, wherein the tubing has an inner surface along which a longitudinal seam extends, comprising:

disposing an anchoring element on the plug assembly, the anchoring element operable to secure the plug assembly within the tubing, wherein the anchoring element is extendable from the plug assembly at a first circumferential position to engage the inner surface of the tubing at a location spaced apart from the seam;

disposing an orientation element configured to engage the seam and positioned on the plug assembly at a second circumferential position that is different from the first circumferential position; and disposing a seal element on the plug assembly between the anchoring element and the orientation element;

wherein the spacing between the first and second circumferential positions is great enough such that when the orientation element engages the seam, the anchoring element engages the inner surface of the tubing but not the seam.

27. The method of claim 26 wherein said orientation element comprises a radially protruding key, and wherein said key and said anchoring element are disposed on opposed circumferential sides.

28. The method of claim 26 wherein said orientation element comprises a mule shoe characterized by a helical outer surface and a helical groove, wherein the helical groove engages the seam.

* * * * *